US008551263B1

(12) United States Patent
Dariavach et al.

(10) Patent No.: US 8,551,263 B1
(45) Date of Patent: Oct. 8, 2013

(54) METHOD FOR REDUCING WHISKER GROWTH

(75) Inventors: Nader Dariavach, Middleboro, MA (US); Jin Liang, Southborough, MA (US); Gordon Barr, Fall River, MA (US); Paul Callahan, Acton, MA (US)

(73) Assignee: EMC Corporation, Hopkinton, MA (US)

( * ) Notice: Subject to any disclaimer, the term of this patent is extended or adjusted under 35 U.S.C. 154(b) by 374 days.

(21) Appl. No.: 12/638,617

(22) Filed: Dec. 15, 2009

(51) Int. Cl.
*C22F 1/02* (2006.01)
*C22F 1/16* (2006.01)

(52) U.S. Cl.
USPC ..... 148/512; 148/528

(58) Field of Classification Search
None
See application file for complete search history.

(56) References Cited

U.S. PATENT DOCUMENTS

2005/0153532 A1* 7/2005 Osenbach et al. ..... 438/611
2007/0109758 A1* 5/2007 Han et al. ..... 361/760
2007/0284700 A1* 12/2007 Jackson et al. ..... 257/642

FOREIGN PATENT DOCUMENTS

JP 09298266 A * 11/1997

* cited by examiner

*Primary Examiner* — George Wyszomierski
(74) *Attorney, Agent, or Firm* — Brian J. Colandreo; Mark H. Whittenberger; Holland & Knight LLP

(57) ABSTRACT

A method of reducing whisker growths includes identifying a solder connection to be treated. The solder connection may contain one or more whisker growths. A heat source is applied at a defined temperature to the solder connection for a defined period of time sufficient to melt at least a portion of the one or more whisker growths. The heat source is removed from the solder connection prior to the melting of the solder connection.

18 Claims, 4 Drawing Sheets

METHOD FOR REDUCING WHISKER GROWTH

TECHNICAL FIELD

This disclosure relates to whisker growth and, more particularly, to methods of reducing whisker growth.

BACKGROUND

The growth of tin whiskers is a very serious reliability issue that complicates the use of lead-free electronic assemblies. Specifically, the growth of such whiskers may lead to electrical short circuits and/or the ultimate failure of the electronic assemblies. Much research has been performed concerning the actual cause of such whisker growth and methods of reducing the same. Unfortunately, the research data shows very complicated, frequently conflicting test results indicating that tin whisker growth is associated with many driving forces (e.g., solder oxidization and external/internal stresses) and the various combinations of these driving forces make the growth of tin whiskers a problem that has been hard to address.

SUMMARY OF DISCLOSURE

In one implementation, a method of reducing whisker growths includes identifying a solder connection to be treated. The solder connection may contain one or more whisker growths. A heat source is applied at a defined temperature to the solder connection for a defined period of time sufficient to melt at least a portion of the one or more whisker growths. The heat source is removed from the solder connection prior to the melting of the solder connection.

One or more of the following features may be included. Applying a heat source may include heating a gas to the defined temperature, thus generating a heated gas. Applying a heat source may include applying the heated gas to the solder connection. Applying the heated gas may include applying the heated gas at a defined pressure sufficient to melt at least a portion of the one or more whisker growths. The defined pressure may be at least 10 psi above atmospheric pressure. The heated gas may include a non-oxidizing gas. The non-oxidizing gas may include nitrogen. The one or more whisker growths may be constructed at least in part of tin extruded from the solder connection. The defined temperature may be greater than the melting point of tin. The defined temperature may be greater than 250 degrees Celsius.

In one implementation, a method of reducing whisker growths includes identifying a solder connection to be treated. The solder connection may contain one or more whisker growths. A gas is heated to a defined temperature, thus generating a heated gas. The heated gas is applied to the solder connection for a defined period of time and at a defined pressure sufficient to melt at least a portion of the one or more whisker growths. The heated gas is removed from the solder connection prior to the melting of the solder connection.

One or more of the following features may be included. The defined pressure may be at least 10 psi above atmospheric pressure. The heated gas may include a non-oxidizing gas. The non-oxidizing gas may include nitrogen. The one or more whisker growths may be constructed at least in part of tin extruded from the solder connection. The defined temperature may be greater than the melting point of tin. The defined temperature may be greater than 250 degrees Celsius.

In one implementation, a method of reducing whisker growths includes identifying a solder connection to be treated. The solder connection may contain one or more tin whisker growths extruded from the solder connection. A heat source is applied at a defined temperature to the solder connection for a defined period of time sufficient to melt at least a portion of the one or more whisker growths. The heat source is removed from the solder connection prior to the melting of the solder connection. The defined temperature is greater than the melting point of tin.

One or more of the following features may be included. Applying a heat source may include heating a gas to the defined temperature, thus generating a heated gas, and applying the heated gas at a defined pressure sufficient to melt at least a portion of the one or more whisker growths. The defined pressure may be at least 10 psi above atmospheric pressure. The heated gas may include a non-oxidizing gas.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF THE PREFERRED EMBODIMENTS

Figure 1:
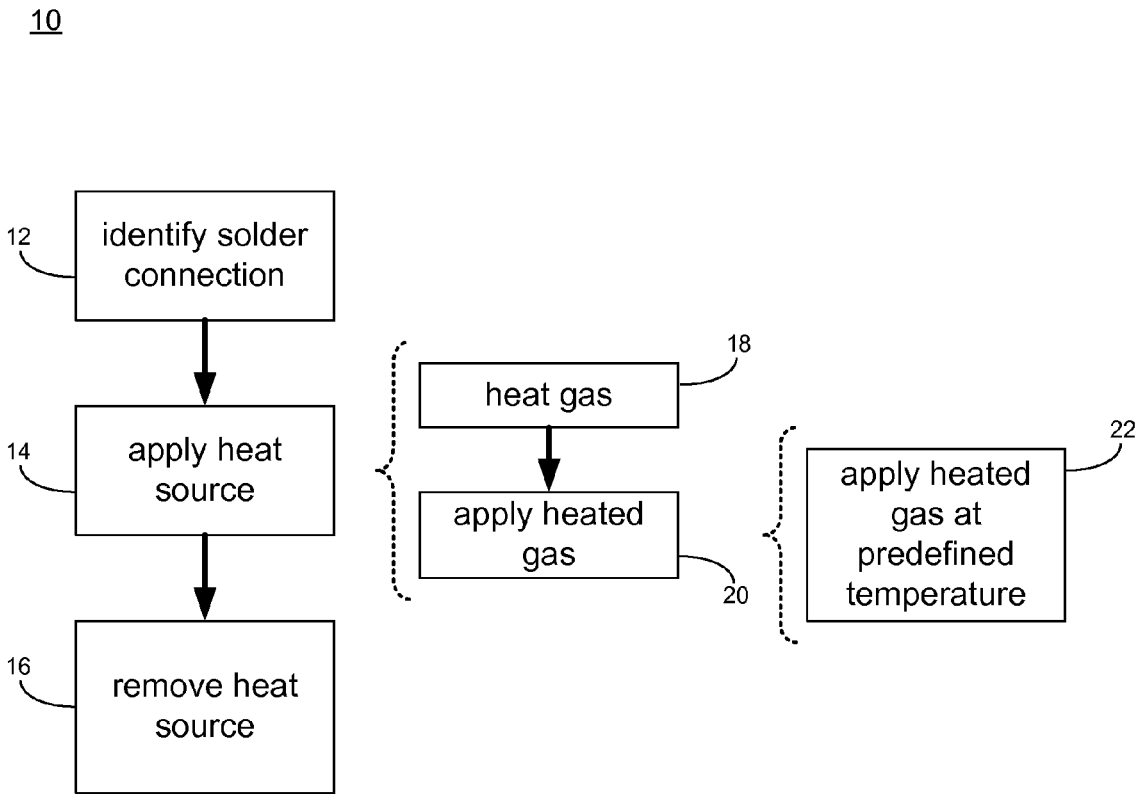
FIG. 1 is a flowchart of a whisker growth reduction method.
Figure 2:
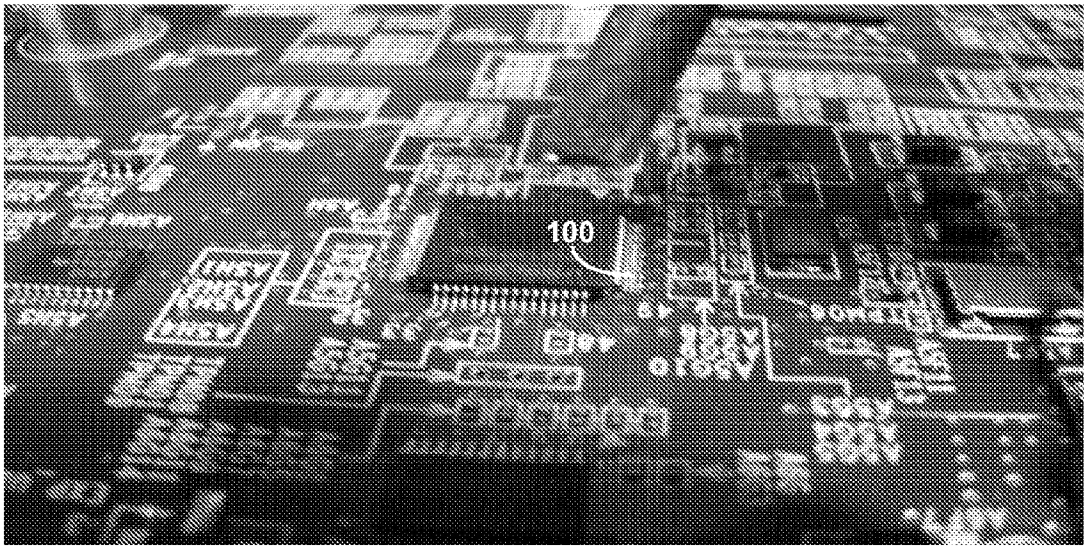
FIG. 2 is an illustration of the whisker growth reduction method being applied to a printed circuit board.

System Overview:

Referring to FIGS. 1 & 2, there is shown method 10 of reducing whisker growths from solder connections. A solder connection (e.g., solder connection 100) to be treated may be identified 12 for treatment. As used in this disclosure, "solder connection" is intended to also encompass solder and/or tin covered component leads (in addition to traditional solder connections).

When identifying 12 the solder connections for treatment, all solder connections may be identified. Alternatively, only those solder connections in danger of having a whisker growth cause a short circuit may be identified. For example, only those solder connections that have a requisite level of connection density (i.e., sufficient to result in a whisker-based short circuit) may be identified. Additionally, the solder connections may be scrutinized and qualified for treatment based upon the type of solder connection. For example, those connections that are soldered with solder including less than 40% lead may be treated for whisker growth due to the higher level of surface tension associated with low-lead solder connection. Alternatively still, solder connections may first be examined under a microscope to determine if treatment is necessary.

Figure 3B:
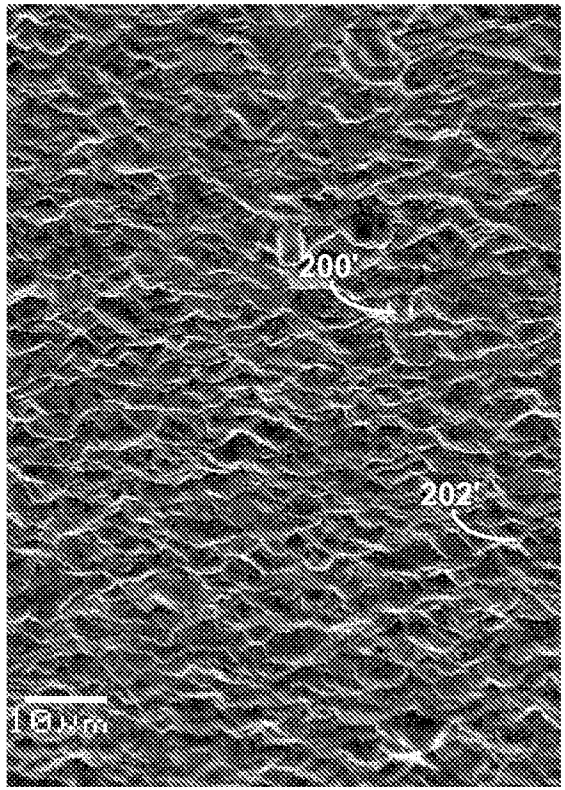
FIG. 3B is a photomicrograph of the solder connection of FIG. 3A subsequent to the application of the method of FIG. 1.
Figure 3A:
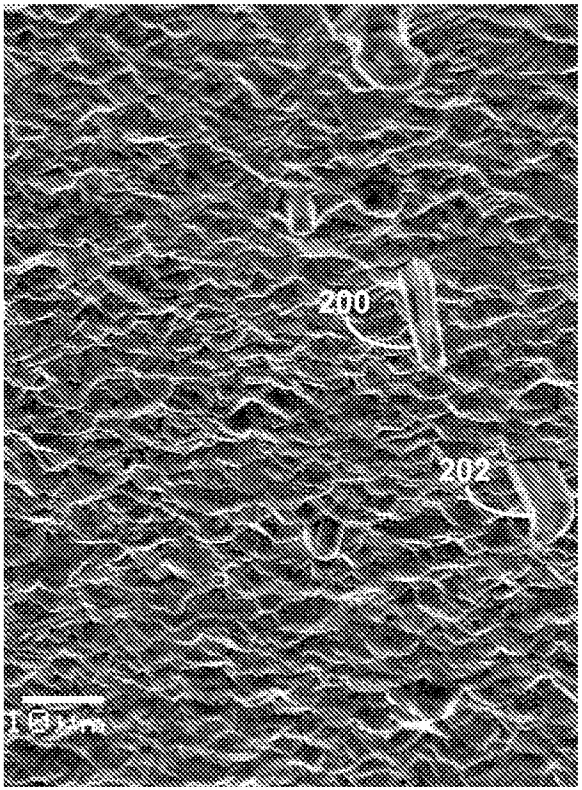
FIG. 3A is a photomicrograph of a solder connection prior to the application of the method of FIG. 1.

Assume for illustrative purposes that FIG. 3A is representative of a microscopic view of a portion of solder connection 100 prior to being treated for whisker growth using method 10, which illustrates various whisker growths (e.g., whisker growths 200, 202). One or more is whisker growths 200, 202 may be constructed at least in part of tin extruded from e.g., solder connection 100.

Once a solder connection (e.g., solder connection 100) to be treated is identified 12, a heat source may be applied 14 (at a defined temperature) to the solder connection (e.g., solder connection 100) for a defined period of time sufficient to melt at least a portion of the whisker growths (e.g., whisker growths 200, 202). However, the heat source may be removed 16 from solder connection 100 prior to the melting of the actual solder connection. An example of such a defined temperature is 250-300° C. (which is above the 232° C. melting point of tin).

Whisker growths may be characterized as having a significantly large surface area per unit volume when compared with solder joints, leads and other electronic components. While whisker growths may grow to a significant length, they are typically only a couple of microns wide. Accordingly, with such a high ratio of surface area to volume, whisker growths tend to melt quickly when subjected to a significantly higher level of heating during application of method 10.

Applying 14 a heat source may include heating 18 a gas to the defined temperature, thus generating a heated gas. This heated gas may then be applied 20 to the previously-identified 12 solder connection (e.g., solder connection 100). Applying 20 the heated gas may include applying 22 the heated gas at a defined pressure sufficient to melt at least a portion of the whisker growths. For example, the heated gas may be applied 22 at a pressure that is at least 10 psi above atmospheric pressure. The heated gas may be a non-oxidizing gas, a example of which includes but is not limited to nitrogen. By using a non-oxidizing gas, the formation of oxides on the surface of solder connection 100 may be reduced, which my help with the prevention of the formation of future whisker growths.

During typical applications of method 10, the defined temperature of the hot gas is approximately 150% of the melting temperature of tin. During a typical application of method 10, the heated gas is typically applied for a short duration of time sufficient to melt (in whole or in part) the whisker growths on the identified 12 solder connection (e.g., solder connection 100). However, by applying 22 the heated gas for only a limited period of time (e.g., typically less than five seconds), the solder connections (e.g., solder connection 100) and electronic assemblies will not receive enough thermal energy to melt/damage the solder connections or electronic assemblies. Typically, the higher the temperature of the heated gas, the shorter the duration of the application of the heated gas.

Figure 4:
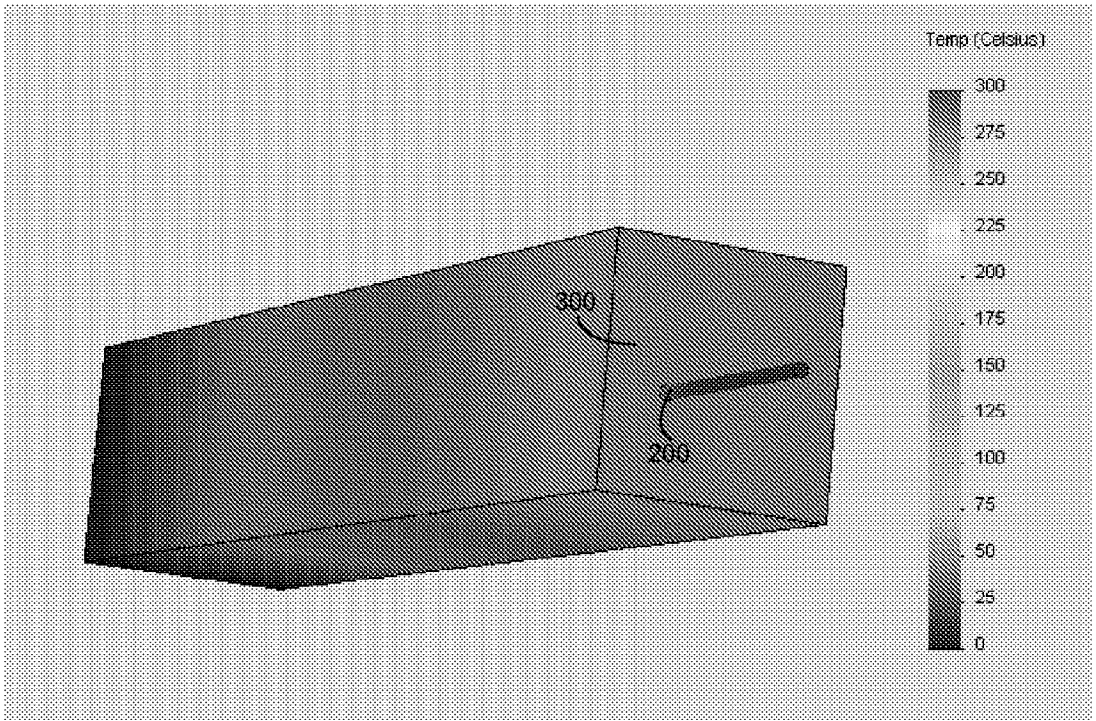
FIG. 4 is a thermal analysis of a portion of a solder connection subsequent to the application of the method of FIG. 1.

Referring also to FIG. 4, there is shown a thermal plot representative of a surface 300 of solder connection 100 and whisker growth 200. The thermal analysis is indicative of the situation in which gas heated 18 and applied 20 for one second. As is easily discernible from the thermal analysis, whisker growth 200 is over to 300° C., which is substantially above the melting point of tin (which is 232° C.). However, surface 300 of solder connection 100 is below the 232° C. tin-melting threshold. Accordingly, by controlling the temperature, pressure and duration of the heated gas applied to solder connection 100, the various whisker growths (e.g., whisker growth 200) may melt without disrupting/damaging the integrity of solder connection 100, resulting in the reduction of whisker growths 200, 202 (as shown in FIG. 3B and represented by melted whisker growths 200', 202').

A number of implementations have been described. Nevertheless, it will be understood that various modifications may be made. Accordingly, other implementations are within the scope of the following claims.

What is claimed is:

1. A method of reducing whisker growths comprising:
identifying a solder connection to be treated;
applying a heat source to the solder connection for a defined period of time, wherein applying the heat source includes:
heating a gas to a defined temperature, thus generating a heated gas; and
applying the heated gas to the solder connection at a defined pressure sufficient to melt at least a portion of one or more whisker growths, wherein the defined pressure is at least 10 psi above atmospheric pressure; and
removing the heat source from the solder connection prior to the melting of the solder connection.

2. The method of claim 1 wherein the heated gas includes a non-oxidizing gas.

3. The method of claim 2 wherein the non-oxidizing gas includes nitrogen.

4. The method of claim 1 wherein the one or more whisker growths are constructed at least in part of tin extruded from the solder connection.

5. The method of claim 4 wherein the defined temperature is greater than the melting point of tin.

6. The method of claim 1 wherein the defined temperature is greater than 250 degrees Celsius.

7. The method of claim 1, wherein the solder connection to be treated has a connection density sufficient to result in a whisker-based short circuit.

8. The method of claim 1, wherein the solder connection to be treated has a surface tension level resulting from a low-lead solder connection.

9. A method of reducing whisker growths comprising:
identifying a solder connection to be treated;
heating a gas to a defined temperature, thus generating a heated gas;
applying the heated gas to the solder connection for a defined period of time and at a defined pressure sufficient to melt at least a portion of one or more whisker growths, wherein the defined pressure is at least 10 psi above atmospheric pressure; and
removing the heated gas from the solder connection prior to the melting of the solder connection.

10. The method of claim 9 wherein the heated gas includes a non-oxidizing gas.

11. The method of claim 10 wherein the non-oxidizing gas includes nitrogen.

12. The method of claim 9 wherein the one or more whisker growths are constructed at least in part of tin extruded from the solder connection.

13. The method of claim 12 wherein the defined temperature is greater than the melting point of tin.

14. The method of claim 9 wherein the defined temperature is greater than 250 degrees Celsius.

15. A method of reducing whisker growths comprising:
identifying a solder connection to be treated; and
applying a heated gas to the solder connection at a defined pressure sufficient to melt at least a portion of one or more whisker growths, wherein the defined pressure is at least 10 psi above atmospheric pressure.

16. The method of claim 15, further comprising:
applying the heated gas at a defined temperature to the solder connection for a defined period of time sufficient to melt at least a portion of the one or more whisker growths, wherein applying the heated gas includes:
heating the gas to the defined temperature, thus generating the heated gas.

17. The method of claim 16, further comprising:

removing the heated gas from the solder connection prior to melting of the solder connection, and wherein the defined temperature is greater than the melting point of tin.

18. The method of claim 15 wherein the heated gas includes a non-oxidizing gas.

* * * * *